US007124911B2

(12) United States Patent
Tramontina et al.

(10) Patent No.: US 7,124,911 B2
(45) Date of Patent: Oct. 24, 2006

(54) CONTAINER AND CARTRIDGE FOR DISPENSING PAPER PRODUCTS

(75) Inventors: Paul Francis Tramontina, Alpharetta, GA (US); Suzanne Michelle Hamlin, Alpharetta, GA (US); Frances Wynn Mayfield, Marietta, GA (US); Leonard Wesley Smith, Jr., Roswell, GA (US); Martin Vozar, Hattiesburg, MS (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 504 days.

(21) Appl. No.: 10/678,662

(22) Filed: Oct. 3, 2003

(65) Prior Publication Data

US 2005/0040177 A1 Feb. 24, 2005

Related U.S. Application Data

(63) Continuation-in-part of application No. 10/657,386, filed on Sep. 8, 2003.

(60) Provisional application No. 60/463,209, filed on Apr. 16, 2003.

(51) Int. Cl.
*A47K 10/24* (2006.01)

(52) U.S. Cl. ..... 221/45; 221/46; 221/52; 221/56; 221/58; 221/59; 221/198

(58) Field of Classification Search ..... 221/33, 221/34, 36, 45–49, 50, 52, 56–60, 197–198, 221/282, 287, 303, 306–307, 309, 312 A; 312/42, 50, 60–61, 71

See application file for complete search history.

(56) References Cited

U.S. PATENT DOCUMENTS

| | | | |
|---|---|---|---|
| 557,553 | A | 4/1896 | Chillberg |
| 813,594 | A | 2/1906 | Sexton |
| 1,072,859 | A | 9/1913 | Kingsley |
| 1,293,291 | A | 1/1919 | Albig |

(Continued)

FOREIGN PATENT DOCUMENTS

| | | |
|---|---|---|
| CH | 344824 | 2/1960 |

(Continued)

*Primary Examiner*—Michael K. Collins
(74) *Attorney, Agent, or Firm*—Richard M. Shane; Nathan P. Hendon

(57) ABSTRACT

The present invention provides a container for dispensing individual paper products that includes a housing, a cover hingedly or removably attached to the housing wherein the cover defines a dispensing opening, a means for elevating paper products, and a plunger disposed in the interior area of the housing. The plunger is urged toward the dispensing opening by the means for elevating paper products. The container may be included in a system for dispensing paper products that further includes a cartridge containing paper products. The cartridge defines a dispensing opening and a second opening wherein the means for elevating paper products extends through the second opening into the interior area of the cartridge to contact the paper products and urge the paper products toward the dispensing opening. The cartridge and container may be configured wherein the second opening is formed by removal of a removable portion during the process of inserting the cartridge into the container.

38 Claims, 13 Drawing Sheets

U.S. PATENT DOCUMENTS

| | | | |
|---|---|---|---|
| 1,362,449 | A | 12/1920 | Teall |
| 1,525,040 | A | 2/1925 | Painter |
| 1,579,429 | A | 4/1926 | Arms |
| 1,785,039 | A | 12/1930 | McCorkindale |
| 2,253,742 | A | 8/1941 | West et al. |
| 3,095,996 | A | 7/1963 | Babin |
| 3,343,716 | A | 9/1967 | Peebles |
| 3,425,595 | A | 2/1969 | Shapira |
| 3,498,688 | A | 3/1970 | Long et al. |
| 3,647,114 | A | 3/1972 | Bleuer |
| 3,726,435 | A | 4/1973 | Williams et al. |
| 3,823,845 | A | 7/1974 | Mott, Sr. et al. |
| 4,094,442 | A | 6/1978 | Radek |
| 4,126,248 | A | 11/1978 | House |
| 4,234,101 | A | 11/1980 | Pastore |
| 4,343,415 | A | 8/1982 | Radek |
| 4,706,844 | A | 11/1987 | Omdoll |
| D296,064 | S | 6/1988 | Omdoll et al. |
| 4,830,354 | A | 5/1989 | Penson |
| 4,838,454 | A | 6/1989 | Salzmann et al. |
| 4,969,575 | A | 11/1990 | Kobayashi |
| 5,143,250 | A | 9/1992 | Freitag |
| 5,540,354 | A | 7/1996 | Annand |
| 5,931,339 | A | 8/1999 | Dodge et al. |
| 6,241,118 | B1 | 6/2001 | Tramontina |
| 6,283,295 | B1 | 9/2001 | Akutagawa et al. |
| 6,378,726 | B1 | 4/2002 | Chan et al. |
| 6,419,113 | B1 | 7/2002 | Tramontina |
| 6,422,416 | B1 | 7/2002 | Tramontina |
| 6,772,908 | B1 | 8/2004 | Roethel et al. |
| 2004/0206769 | A1* | 10/2004 | Sanders et al. ..... 221/59 |
| 2006/0027590 | A9* | 2/2006 | Tramontina et al. ..... 221/46 |

FOREIGN PATENT DOCUMENTS

| | | |
|---|---|---|
| CH | 368913 | 4/1963 |
| DE | 8911997 | 11/1989 |
| WO | WO 99/30601 | 6/1999 |
| WO | WO 00/33713 | 6/2000 |

* cited by examiner

CONTAINER AND CARTRIDGE FOR DISPENSING PAPER PRODUCTS

RELATED APPLICATIONS

This application is a continuation-in-part of application Ser. No. 10/657,386 entitled CONTAINER AND CARTRIDGE FOR DISPENSING PAPER PRODUCTS and filed in the U.S. Patent and Trademark Office on Sep. 8, 2003, which claims priority to U.S. Provisional Application Ser. No. 60/463,209, filed on Apr. 16, 2003. The entireties of application Ser. Nos. 10/657,386 and 60/463,209 are hereby incorporated by reference.

BACKGROUND OF THE INVENTION

Various types of dispensers for paper products have been developed to provide ready availability of the paper products to users. Such dispensers are often provided in public places such as restaurants or rest rooms where customers remove from the dispenser a desired amount of paper products for personal use. In some high traffic areas, such as fast food restaurants, a large number of customers may use a paper product dispenser such as a napkin dispenser in a short period of time. Therefore, dispensers have been developed that hold a large number of paper products for use by a large number of consumers.

For many applications, it is desirable to have a large dispenser that is embedded in a countertop. This is particularly desirable when open counter space above the countertop is needed for visibility or other reasons. Unfortunately, large recessed dispensers are subject to a number of drawbacks. First, because access to the body of the dispenser is limited by the structure supporting the countertop, it can be difficult to load large quantities of napkins into a recessed dispenser. Second, if paper products are not properly loaded into the dispenser, the paper products may jam as they are removed thereby preventing further removal of paper products by users. Third, a person refilling a large dispenser is more likely, due to the larger number of paper products involved, to drop some of the paper products onto a floor. Any dropped paper products are then unsanitary and must be discarded, thereby creating more waste and defeating certain benefits of the larger dispenser.

Therefore, there is a need for large inverted and/or recessed dispensers that reduce the incidence of waste of paper products due to dropping of the paper products during refilling of the container. There is likewise a need for such dispensers that reduce the incidence of jamming of paper products and the resultant inability to dispense further paper products, and further that supports the weight of paper products and moves the paper products toward the dispenser opening so that individual paper products are readily removed.

SUMMARY OF THE INVENTION

The aforesaid needs are fulfilled and the problems experienced by those skilled in the art overcome by the system for dispensing individual paper products of the present invention. In one embodiment, a system for dispensing individual paper products includes a container and a cartridge containing paper products at least partially within the interior area of the container. The container includes a housing including side walls and a bottom wall defining an interior surface and an interior area within the interior surface, a cover hingedly or removably attached to the housing wherein the cover defines a dispensing opening, a spring disposed in the interior area of the housing, and a plunger disposed in the interior area of the housing wherein the spring is compressed between the plunger and at least one of the walls, and further wherein the plunger is urged toward the dispensing opening by the spring. The cartridge defines a removable portion adapted to become separated from the cartridge by contact with the plunger when the cartridge is inserted in the container. Removal of the removable portion creates a second opening. After the removable portion is separated from the cartridge the plunger extends through the second opening into the cartridge to urge the removable portion to contact the paper products and urge the paper products toward the dispensing opening.

In one aspect, the plunger may have the shape of a truncated cone. Desirably, the truncated cone may include a bottom surface having a diameter substantially equivalent to the diameter of the spring.

In a further aspect, the plunger may include at least one stabilizing wing. Desirably, the stabilizing wing has an outer edge that contacts the inside surface of the housing to prevent the plunger from binding in the housing.

In another aspect, the removable portion may act as an internal platform in contact with the plunger. The internal platform in turn contacts the paper products within the cartridge to urge the paper products toward the dispensing opening. Desirably, the internal platform applies substantially constant pressure against the paper products to uniformly support and urge the paper products. The sides of the internal platform may define notches to minimize contact of the internal platform with the internal surface of the housing.

In a further aspect, the cartridge includes cartridge side walls, a first end wall, and a second end wall opposing the first end wall. The first end wall defines a third opening for dispensing the paper products. The second end wall defines the removable portion.

In another aspect, the removable portion may include at least one flap attached to the cartridge. The removable portion may include a first flap having a tab and a second flap having a slot, the tab being removably inserted in the slot. Additionally, the removable portion may be defined by perforations or slits in a wall of the cartridge.

In another aspect, the container described above may be positioned within a supporting structure. Desirably, the container may be supported within the supporting structure by flanges intersecting the side walls at the edges farthest from the bottom wall. Even more desirably, the container is oriented such that paper products are urged toward the dispensing opening in a substantially vertical direction. In one aspect, the cover is flush with the supporting structure. Alternatively, the cover may extend slightly from the supporting structure.

In another embodiment, a system for dispensing individual paper products includes a container and a cartridge containing paper products at least partially within the interior area of the container. The container includes a housing including side walls and a bottom wall defining an interior surface and an interior area within the interior surface for receiving a plurality of the paper products, a cover hingedly or removably attached to the housing wherein the cover defines a dispensing opening, and a means for elevating paper products. The cartridge defines a removable portion adapted to become separated from the cartridge by contact with the means for elevating paper products when the cartridge is inserted in the container. Removal of the removable portion creates a second opening. After the removable portion is separated from the cartridge the means for elevating paper products extends through the second opening into the cartridge to urge the removable portion to contact the paper products and urge the paper products toward the dispensing opening.

In a further embodiment, a system for dispensing individual paper products includes a container and a cartridge containing paper products at least partially within the interior area of the container. The container includes a housing including walls defining an interior surface and an interior area within the interior surface, a cover wherein the cover defines a dispensing opening, a spring disposed in the interior area of the housing, and a plunger disposed in the interior area of the housing wherein the spring is compressed between the plunger and at least one of the walls. Further, the plunger is urged toward the dispensing opening by the spring. The cartridge defines a removable portion capable of becoming separated from the cartridge by contact with the plunger when the cartridge is inserted in the container. Separation of the removable portion from the cartridge creates a second opening. After separation of the removable portion from the cartridge the plunger extends through the second opening into the cartridge to urge the removable portion to contact the paper products and urge the paper products toward the dispensing opening.

In another embodiment, a method for loading paper products in a system for dispensing paper products includes the steps of a) providing a container, the container including a housing including side walls and a bottom wall defining an interior surface and an interior area within the interior surface, a cover hingedly or removably attached to the housing wherein the cover defines a dispensing opening, a spring disposed in the interior area of the housing, and a plunger disposed in the interior area of the housing wherein the spring is compressed between the plunger and at least one of the walls, and further wherein the plunger is urged toward the dispensing opening by the spring, b) providing a cartridge containing paper products, the cartridge defining a removable portion adapted to become separated from the cartridge by contact with the plunger when the cartridge is inserted in the container, and c) inserting the cartridge in the container to cause the plunger to separate the removable portion from the cartridge to create a second opening, wherein after the removable portion is separated from the cartridge the plunger extends through the second opening into the cartridge to urge the removable portion to contact the paper products and urge the paper products toward the dispensing opening.

In one embodiment, a system for dispensing individual paper products includes a container and a cartridge containing paper products, the cartridge being positioned at least partially within the interior area of the container. The container includes a housing including side walls and a bottom wall defining an interior surface and an interior area within the interior surface, a cover hingedly or removably attached to the housing wherein the cover defines a dispensing opening, a spring disposed in the interior area of the housing, a plunger disposed in the interior area of the housing wherein the spring is compressed between the plunger and at least one of the walls, and further wherein the plunger is urged toward the dispensing opening by the spring, and at least one internal member anchored to the bottom wall. The cartridge defines a removable portion adapted to become separated from the cartridge by contact with the at least one internal member when the cartridge is inserted in the container. Removal of the removable portion creates a second opening. After the removable portion is separated from the cartridge the plunger extends through the second opening into the cartridge to urge the removable portion to contact the paper products and urge the paper products toward the dispensing opening.

In one aspect, the at least one internal member may include at least one tower. In a further aspect, the at least one tower may include four towers. In an even further aspect, the towers may include tops having cross-sectional areas of greater than about 0.5 $cm^2$.

In another aspect, the removable portion may act as an internal platform in contact with the plunger. The internal platform in turn contacts the paper products within the cartridge to urge the paper products toward the dispensing opening. Desirably, the internal platform applies substantially constant pressure against the paper products to uniformly support and urge the paper products. The sides of the internal platform may define notches to minimize contact of the internal platform with the internal surface of the housing.

In a further aspect, the cartridge includes cartridge side walls, a first end wall, and a second end wall opposing the first end wall. The first end wall defines a third opening for dispensing the paper products. The second end wall defines the removable portion.

In another aspect, the removable portion may include at least one flap attached to the cartridge. The removable portion may include a first flap having a tab and a second flap having a slot, the tab being removably inserted in the slot. Additionally, the removable portion may be defined by perforations or slits in a wall of the cartridge.

In another embodiment, a system for dispensing individual paper products includes a container and a cartridge containing paper products at least partially within the interior area of the container. The container includes a housing including side walls and a bottom wall defining an interior surface and an interior area within the interior surface for receiving a plurality of the paper products, a cover hingedly or removably attached to the housing wherein the cover defines a dispensing opening, a means for elevating paper products, and at least one internal member anchored to the bottom wall. The cartridge defines a removable portion adapted to become separated from the cartridge by contact with the at least one internal member when the cartridge is inserted in the container. Removal of the removable portion creates a second opening. After the removable portion is separated from the cartridge the means for elevating paper products extends through the second opening into the cartridge to urge the removable portion to contact the paper products and urge the paper products toward the dispensing opening.

In a further embodiment, a system for dispensing individual paper products includes a container and a cartridge containing paper products at least partially within the interior area of the container. The container includes a housing including walls defining an interior surface and an interior area within the interior surface, a cover wherein the cover defines a dispensing opening, a spring disposed in the interior area of the housing, a plunger disposed in the interior area of the housing wherein the spring is compressed between the plunger and at least one of the walls, and at least one internal member anchored to a bottom wall. Further, the plunger is urged toward the dispensing opening by the spring. The cartridge defines a removable portion capable of becoming separated from the cartridge by contact with the at least one internal member when the cartridge is inserted in the container. Separation of the removable portion from the cartridge creates a second opening. After separation of the removable portion from the cartridge the plunger extends through the second opening into the cartridge to urge the removable portion to contact the paper products and urge the paper products toward the dispensing opening.

In another embodiment, a method for loading paper products in a system for dispensing paper products includes the steps of a) providing a container, the container including a housing including side walls and a bottom wall defining an interior surface and an interior area within the interior surface, a cover hingedly or removably attached to the housing wherein the cover defines a dispensing opening, a spring disposed in the interior area of the housing, a plunger disposed in the interior area of the housing wherein the spring is compressed between the plunger and at least one of the walls, and further wherein the plunger is urged toward the dispensing opening by the spring, and at least one internal member anchored to the bottom wall, b) providing a cartridge containing paper products, the cartridge defining a removable portion adapted to become separated from the cartridge by contact with the plunger when the cartridge is inserted in the container, and c) inserting the cartridge in the container to cause the internal member to separate the removable portion from the cartridge to create a second opening, wherein after the removable portion is separated from the cartridge the plunger extends through the second opening into the cartridge to urge the removable portion to contact the paper products and urge the paper products toward the dispensing opening.

Other features and aspects of the present invention are discussed in greater detail below.

BRIEF DESCRIPTION OF THE DRAWINGS

The present invention will be more fully understood from the following detailed description, taken in conjunction with the accompanying drawings (not to scale), wherein like reference numerals refer to like parts, and in which.

DETAILED DESCRIPTION

Figure 1:
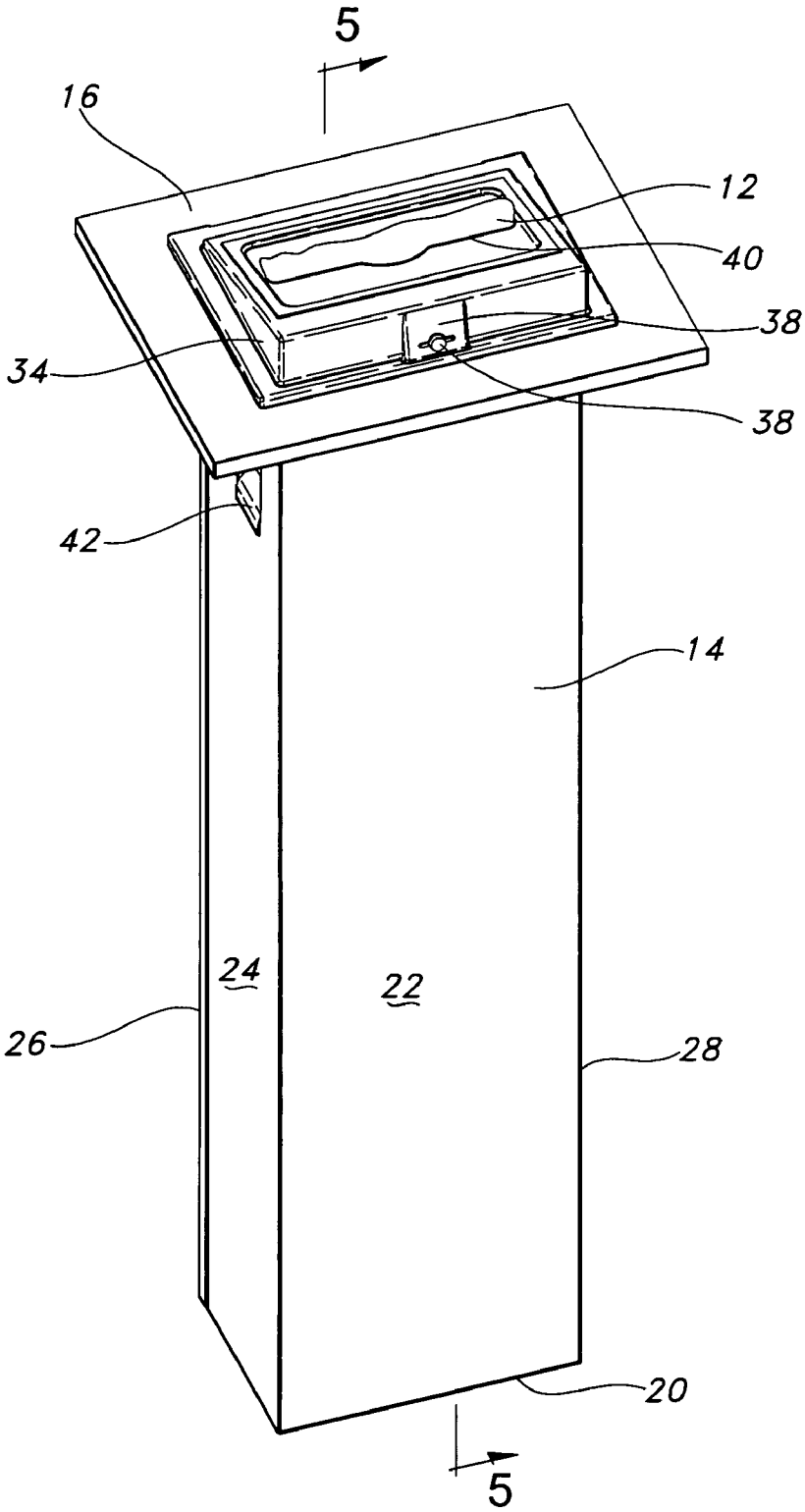
FIG. 1 is a perspective view of an exemplary container for dispensing paper products.

Reference will now be made in detail to various embodiments of the invention, one or more examples of which are illustrated in the drawings (not to scale). Each example is provided by way of explanation of the invention and not meant as a limitation of the invention. For example, features illustrated or described as part of one embodiment or figure can be used on another embodiment or figure to yield yet another embodiment. It is intended that the present invention include such modifications and variations.

The present invention is directed to a container for dispensing sheet-like materials. Various sheet-like materials can be dispensed from the container of the present invention such as, for example, paper, nonwoven, and other products. Exemplary sheet-like products include, but are not limited to, facial tissue, towels, bathroom tissue, wipers, napkins, seat covers and so forth. The specific composition of the sheet materials dispensed can vary as desired. Exemplary sheet-like materials and methods of making the same include, but are not limited to, those described in U.S. Pat. Nos. 3,301,746; 3,322,617; 3,650,882; 4,100,324; 4,436,780; 4,659,609; 4,737,393; 5,048,589; 5,284,703; 5,399,412; 5,494,554; 5,607,551; 5,672,248; 5,716,691; 5,772,845; 5,776,306; 6,077,590; 6,273,996; 6,096,152 and so forth. While paper products are generally discussed with regard to the embodiments described herein below, it will be understood that various other products could be substituted therefore.

The container of the present invention can hold and dispense significant numbers of individual sheets. Desirably, the container is sized to hold and dispense at least about 250 sheets. By way of example, the container can contain between about 400 and about 1000 sheets. In certain embodiments, the container can contain and dispense between about 700 and about 900 sheets.

Referring to FIG. 1, a container 10 is disclosed for dispensing paper products 12. The container 10 includes a housing 14 in which the paper products 12 are placed and from which the paper products 12 are dispensed. Optionally, the paper products 12 may be contained within a cartridge which is placed within the housing 14. The container can be positioned in a vertical or horizontal orientation either alone or within a supporting structure or surface. In one embodiment, the container is installed in a countertop 16 or other suitable substantially planar surface.

The housing 14 includes a bottom wall 20 and a number of side walls including a first side wall 22, a second side wall 24, a third side wall 26, and a fourth side wall 28 for housing the paper products 12. The side walls 22, 24, 26, 28 intersect the bottom wall to define an interior surface 30 (see FIG. 2) of housing 14, within which an interior area 32 (see FIG. 2) is located. The side walls 22, 24, 26, 28 and the bottom wall 20 may each, if desired, be made of two or more planar portions. Such construction strengthens the housing 14 and is useful in locations where the housing might be vandalized. The outer portions of the side walls 22, 24, 26, 28 help withstand any blow or impact to the housing 14 to prevent destruction of the housing, removal of the housing from its mounting, or removal of paper products 12 from the housing.

The container 10 further includes a cover 34 which is removably or hingedly attached to one of the side walls 22, 24, 26, 28. The cover 34 may be flush with or extend slightly from the countertop 16 or other surface in which the container 10 is installed. The cover 34 is openable for insertion of paper products 12 into the interior area of the housing 14 when the supply of paper products 12 is depleted and/or runs low. Desirably, the cover 34 includes one or more fasteners 36 that hold the cover closed. As used herein, the term "fasteners" means devices that fasten, join, connect, secure, hold, or clamp components together. Fasteners include, but are not limited to, hooks, hook and eye fasteners, latches, snaps, snap-fits, clips, clasps, loop fasteners, interlocking male/female connectors, fishhook connectors, and so forth. The fastener 36 is openable when desired to reopen the cover 34. In one embodiment, the fastener 36 is openable by pressing a button 38. The cover 34 defines a dispensing opening 40 through which the paper products 12 pass as they are dispensed.

Desirably, at least one protrusion extends into the interior area of the housing. In one embodiment, as partially shown in FIG. 1, the second side wall 24 and the fourth side wall 28 include protrusions 42 extending into the interior area of the housing 14. However, the protrusions 42 could be disposed on any of the walls and one wall can have multiple protrusions. In those embodiments wherein pairs of protrusions are disposed on opposing walls of the housing 14, they can be disposed at the same height or different heights (i.e., staggered). The protrusions 42 desirably comprise a generally downwardly angled structure and can have a geometric and/or curvilinear structure. By way of example only, the protrusions can comprise curved bumpers that may include a plurality of ridges extending across the curved bumpers perpendicular to the dispensing direction. The protrusions 42 extend into the interior area 32 to contact paper products 12 and thereby oppose the movement of paper products 12 in the dispensing direction. By extending into the interior area 32 to contact paper products 12, the protrusions 42 impede the movement of paper products 12 toward the dispensing opening, but do not prohibit such movement. The use of protrusions to control dispensing is described, for example, in U.S. Pat. No. 6,241,118 to Tramontina and U.S. Pat. No. 6,378,726 to Chan et al., the entire contents of which are incorporated herein by reference thereto.

Figure 2:
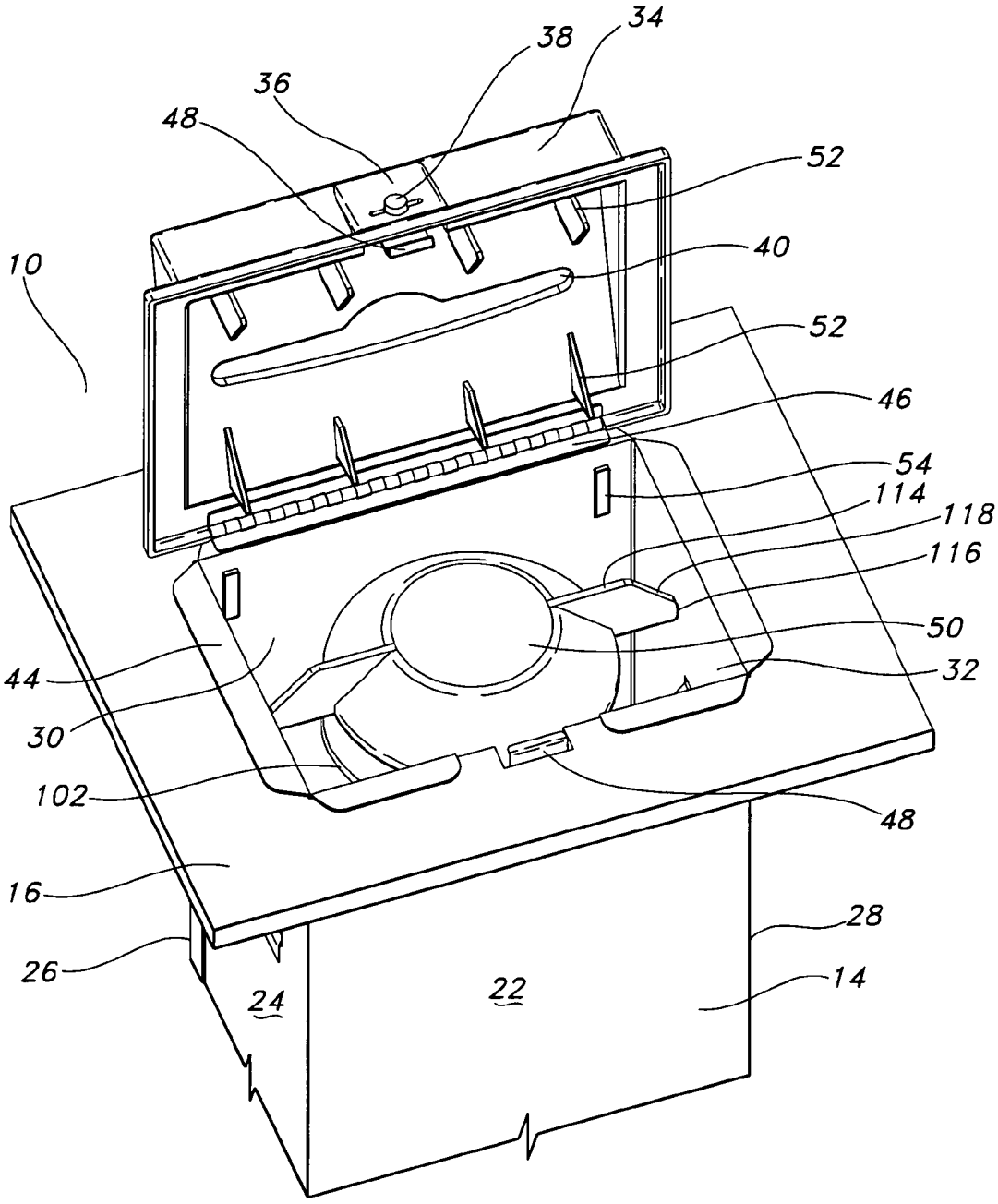
FIG. 2 is a perspective view of the open container of FIG. 1.

Referring now to FIG. 2, the housing 14 is supported within the countertop 16 by flanges 44 that extend outwardly from the side walls 22, 24, 26, 28. When the housing 14 is inserted in an opening in the countertop 16 slightly larger than the cross-section of the housing 14, the housing is supported within the countertop by the flanges 44. Desirably, the flanges 44 intersect the side walls 22, 24, 26, 28 at the edges farthest from the bottom wall 20. This allows the container 10 to be seated substantially flush with the surface of the countertop 16. The flanges may be fastened to the countertop or other surface by suitable fastening devices. Suitable fastening devices include, but are not limited to, screws, nuts and bolts, rivets, snap-fits, tacks, nails, adhesives, and so forth.

As noted above, the cover 34 may be hingedly attached to one of the side walls 22, 24, 26, 28 by a hinge 46. As used herein, the term "hinge" refers to a jointed or flexible device that connects and permits pivoting or turning of a part to a stationary component. Hinges include, but are not limited to, pivotable connectors, such as those used to fasten a door to frame, and living hinges. Living hinges may be constructed from plastic and formed integrally between two members. A living hinge permits pivotable movement of one member in relation to another connected member. The cover 34 is openable for insertion of paper products 12 into the interior area 32 of the housing 14 when the supply of paper products is depleted and/or runs low. The fastener 36 that holds the cover 34 closed may, for example, include interlocking tabs 48. At least one of the interlocking tabs 48 is movable when desired to reopen the cover 34 by pressing the button 38. Any other type of fastener 36 known to those skilled in the art for reopenably securing the cover 34 may be used.

Figure 5:
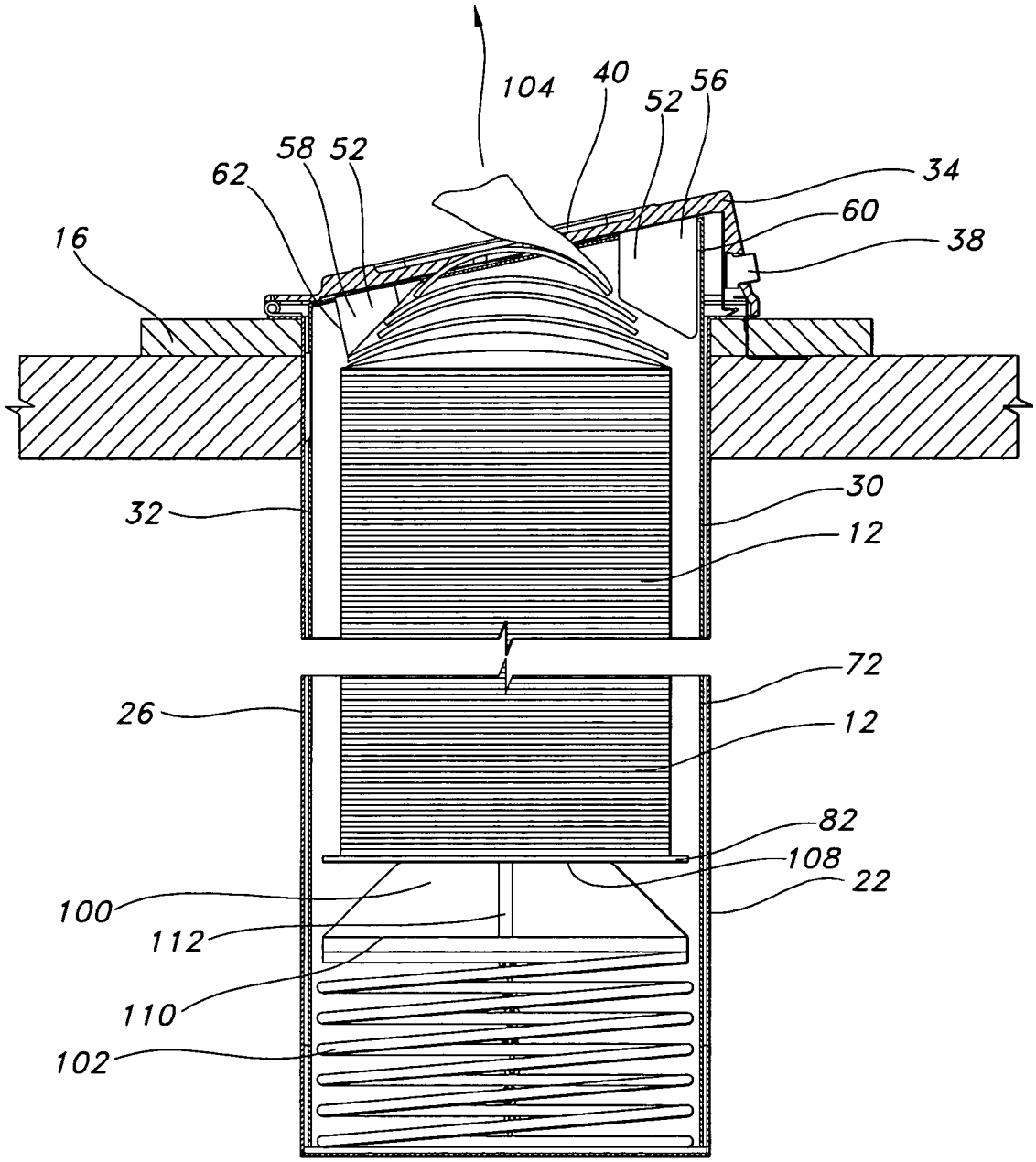
FIG. 5 is a cross-sectional view of the container of FIG. 1 taken along line 5—5 of FIG. 1.

Desirably, the cover 34 further includes a group of control ribs 52 that extend into the interior area 32 to contact paper products when the cover is in the closed position. The control ribs 52 space, slow, align, and/or support paper products as the same are moved toward the cover 34 and through the dispensing opening 40. Size, shape, and spacing of the control ribs can be used to control dispensing of the paper products. Referring now to FIG. 5, the control ribs 52 may have different dimensions to properly support and guide the paper products into the dispensing opening 40. For example, a tall rib member 56 extends into the interior area 32 by a greater amount than a short rib member 58. The tall rib members 56 and short rib members 58 are illustrated to show an exemplary dispensing configuration. Additionally, a side surface 60 of the tall rib member 56 closest to the interior surface 30 may be configured so there is little or no offset from the interior surface. A side surface 62 of the short rib member 58 may be offset from the interior surface 30 by a greater amount.

As one example, the tall rib member 56 may have a height ranging from about 1 to about 2 inches at the location where it intersects with the first side wall 22 and an offset or height ranging from about 0.1 to about 0.5 inch adjacent the dispensing opening 40. The short rib member 58 may have a height ranging from about 0.5 to about 1.5 inch at the location where it intersects with the third side wall 26 and an offset or height ranging from 0 to about 0.25 inch adjacent the dispensing opening 40. The rib members may have various widths or thicknesses and the width of a rib member may vary along any dimension or dimensions. Desirably, the portion of the rib member contacting the paper product will be relatively thin and smooth to minimize friction. The use of rib members is further described in U.S. Pat. No. 6,241,118 to Tramontina and PCT Publication WO 99/30601, the entire contents of which are incorporated herein by reference.

Referring again to FIG. 2, the container 10 further includes a means for elevating paper products 50 toward the dispensing opening 40 in the cover 34. Various alternatives are possible within the scope of the invention to elevate paper products toward the cover 34. The means for elevating paper products 50 may comprise any structure that allows paper products to be urged toward and dispensed from the dispensing opening 40 in the cover 34. The means for elevating paper products 50 is discussed more fully below in conjunction with FIG. 5.

The dispensing opening 40 may have many shapes within the scope of the present invention, as long as the opening provides easy access for a user. Optionally, the dispensing opening may also be configured to provide metered delivery of individual paper products. Desirably, the paper products 12 are interfolded, tabbed, or tab interfolded to provide metered feeding of individual paper products one at a time. Folding devices, such as boards or plates, have long been used to longitudinally fold webs and other sheet-like materials in order to form a stack of folded sheets. The sheets are, generally speaking, drawn over the folding device wherein the shape and configuration of the device causes the sheet to twist and bend thereby producing the desired fold. Folding devices have heretofore been provided in a variety of shapes and configurations in order to achieve the desired fold lines and folding patterns. Folding devices have been used to form a number of different folds including, for example, half-folds, quarter folds, c-folds, v-folds, j-folds, w-folds, z-folds, and so forth.

In addition, for more complex folds requiring multiple fold lines, it is known to form the necessary fold lines using two or more folding devices in series. In this regard, folding boards have also been used in series to achieve inter-folded or inter-leafed sheets, that is to say sheets folded such that they partially envelope portions of another sheet. Interleafed sheets are commonly employed in stacks as a mechanism to facilitate removal of the individual sheets from a dispenser. Withdrawal of a first sheet through a dispenser opening pulls the enveloped portion of a second sheet through the dispenser opening such that it extends out of the dispenser opening and is exposed. Having a portion of the subsequent sheet extending out of the dispenser opening greatly facilitates removal of the same from the dispenser by the user. By way of example only, various folding devices, folding patterns and inter-folding schemes are described in the following U.S. Pat. Nos. 3,401,928; 3,679,094; 3,817,514; 3,841,620; 4,131,271; 4,502,675; 5,868,276; 6,045,002; and 6,168,848. However, the present invention does not require the use of interfolded paper products.

Optionally, the housing 14 may include one or more tabs 54 attached to the interior surface 30 near the opening in the housing 14 through which paper products are loaded. The tabs 54 are dimensioned such that they inhibit a cartridge containing paper products from being loaded in an improper orientation. The tabs 54 align with slots in a cartridge such that the slots will catch on the tabs 54 if the cartridge is not oriented properly prior to loading the cartridge into the housing 14. When the cartridge is aligned properly, there are no slots to catch on the tabs 54 and the cartridge will slide into the housing 14 unimpeded.

The housing 14 may be made from numerous materials and by numerous methods known to those skilled in the art. The housing 14 may be made of plastic such as polyethylene, nylon, and so forth. However, other suitable materials, such as other plastics or metals, may be provided for any or all of the parts of the housing 14. As one example, the housing 14 may be made of an injection-molded plastic. The protrusions 42, control ribs 52, and tabs 54 are desirably formed integral with the housing 14. However, the protrusions 42, control ribs 52, and tabs 54 may be formed separately from the housing 14 and attached later. Also, the protrusions 42, control ribs 52, and tabs 54 may be made of different material from the housing 14 if desired. For example, the protrusions 42, control ribs 52, and tabs 54 may be made of a more resilient material than the materials described above, such as an elastomer or rubber.

Figure 3:
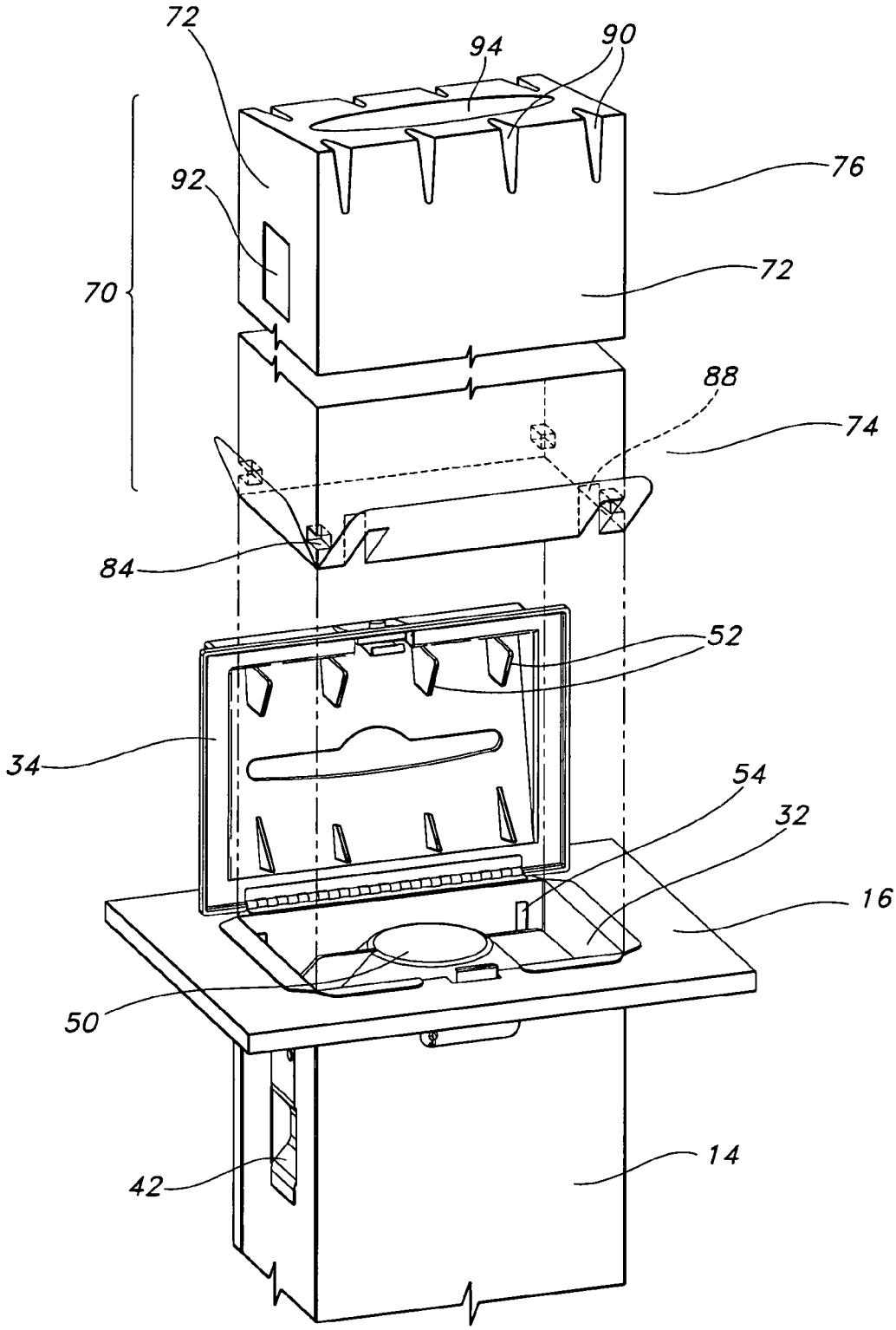
FIG. 3 is an exploded perspective view of the container and cartridge of FIG. 2 with the cartridge inserted into the container.

Desirably, as mentioned above, a cartridge may be provided for holding paper products to be dispensed to a user. As shown in FIG. 3, a cartridge 70 having outside walls 72 is provided for insertion into the interior area 32 of the housing 14 for containing paper products 12 to be dispensed. The cartridge has a bottom end 74 that is adapted to receive the means for elevating paper products 50 and a top end 76 adapted to dispense paper products 12. The cartridge 70 is sized to fit within the interior area 32 of the housing 14. Desirably, the cartridge 70 is sized to be only slightly smaller than the housing 14 to maximize the number of paper products 12 contained within the cartridge.

The cartridge 70 can hold and dispense significant numbers of individual sheets. Desirably, the cartridge 70 is sized to hold and dispense at least about 250 sheets. By way of example, the cartridge 70 can contain between about 400 and about 1000 sheets. In certain embodiments, the cartridge 70 can contain and dispense between about 700 and about 900 sheets.

Desirably, the cartridge includes a plurality of removable portions, the removal of which creates openings through the cartridge. One such removable portion may be disposed at the bottom end of the cartridge. Removal of the removable portion at the bottom end of the cartridge allows the cartridge to receive the means for elevating paper products when the cartridge is loaded into the housing. Alternatively, the removable portion may be flaps which can be folded back to create an opening. As shown in FIG. 3, in one embodiment the cartridge 70 includes one or more flaps 80 disposed in the bottom wall of the cartridge 70. The flaps 80 are folded back prior to loading the cartridge 70 into the housing 14. Folding back the flaps 80 allows the cartridge 70 to receive the means for elevating paper products 50.

Desirably, the cartridge includes at least one removable portion that can be removed to create a slot 88 that, as discussed above, will prevent misalignment of the cartridge in the housing. The slots 88 are positioned such that when the cartridge is improperly oriented, the slots will catch on tabs 54 positioned on the interior surface of the housing. The slots 88 may be positioned in one of the outside walls 72 of the cartridge 70. Alternatively, the slots 88 may be positioned in the flaps 80 that are opened prior to insertion of the cartridge 70 in the housing 14. When the flaps 80 are opened, they fold back against the outside walls 72 of the cartridge 70 where the slots 88 would be in position to engage the tabs 54 if the cartridge is not oriented correctly.

The cartridge 70 may include at least one of another removable portion at the top end 76 of the cartridge 70 so that paper products 12 can be supported and aligned by the control ribs 52 for dispensing through the dispensing opening 40. Removal of the removable portions creates openings 90 through which the control ribs 52 extend.

The cartridge 70 may include at least one of another removable portion that corresponds to the protrusions 42 in the housing 14. The removable portions are disposed in the outside walls 72 of the cartridge 70 so that, once the removable portions are removed, openings 92 can encompass and receive the protrusions 42 extending from the interior surface 30 of the housing 14. Thus, upon removal of the removable portions and placement of the cartridge 70 in the housing 14, the protrusions 42 and rib members 58 contact the paper products 12 within the cartridge 70 and act upon the paper products as described above.

The top end 76 of the cartridge 70 may be formed having a removable portion corresponding to the dispensing opening 40. Removal of this removable portion creates an opening 94 through which the paper products are dispensed.

The removable portions may either be removed (or simply not formed) during manufacture of the cartridge or removed just prior to installation of the cartridge in the housing. If the removable portions are to be removed as part of the manufacturing process, the cartridge should be shipped to the user wrapped, for example in a polyethylene bag, to preserve the sterility of the paper products in the cartridge. If the removable portions are to be removed as part of the installation process, the edges of the removable portions should be weakened, scored, etc. for easy removal. If a removable portion is used to provide access for the means for elevating the paper products, it should not be removed as part of the manufacturing process to ensure that the paper products remain properly loaded in the cartridge 70 until the time at which the cartridge is to be inserted in the housing 14.

The cartridge 70 is desirably made of heavy paper or cardboard, but may be made of any other suitable material known to those skilled in the art.

Figure 4:
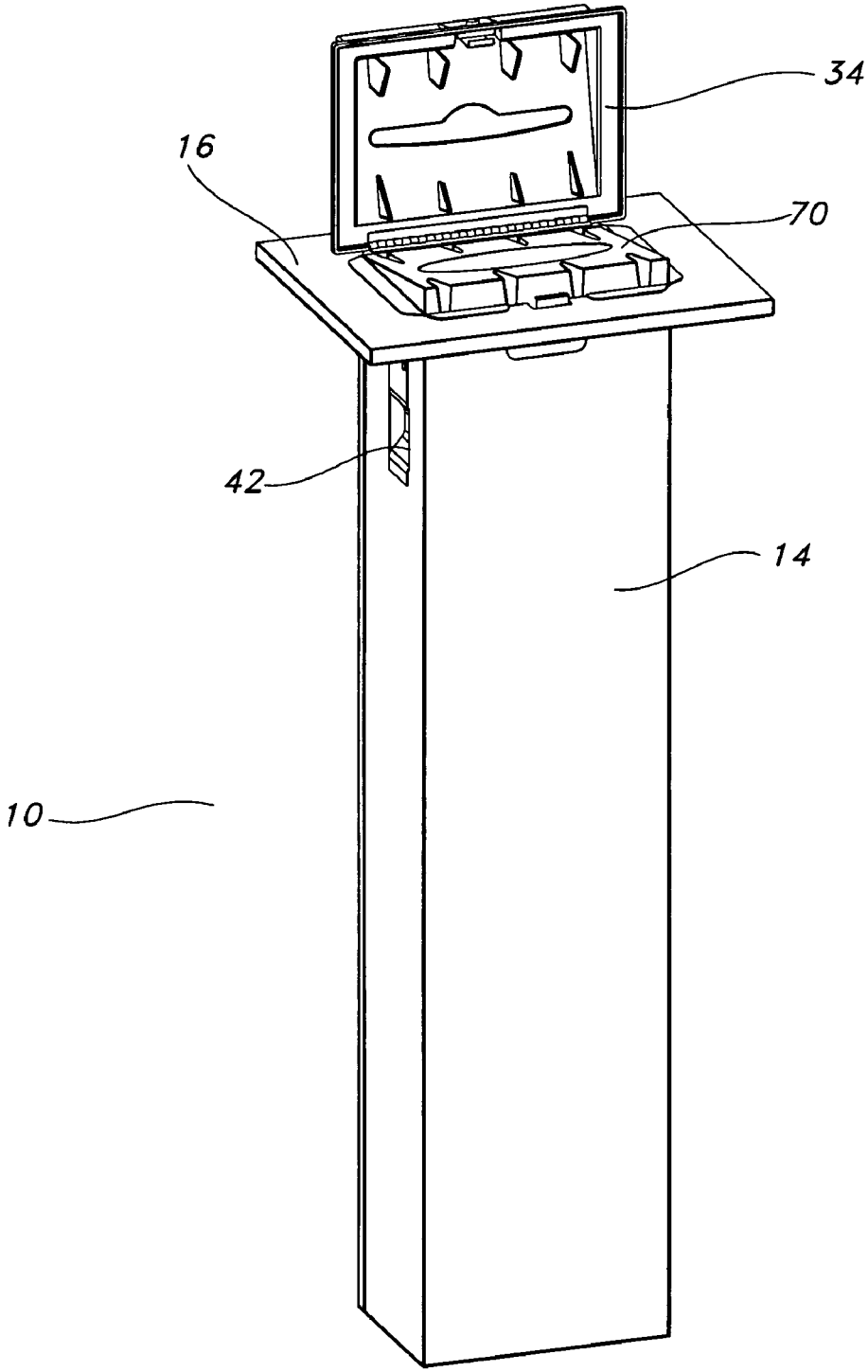
FIG. 4 is a perspective view of the container shown in FIG. 1 showing the cartridge in the container.

FIG. 4 is a perspective view showing the cartridge 70 fully inserted into the housing 14 mounted in the countertop 16.

Referring now to FIG. 5, a plunger 100 is disposed within the interior area 32 of the housing 14 along with at least one spring 102. When the spring 102 is compressed by the plunger 100, the spring 102 urges the plunger 100 in the dispensing direction 104. Thus, when paper products 12 are placed in the container 10 and the plunger 100 is depressed thereby compressing the spring 102, the plunger 100 and the spring 102 urge the paper products 12 toward the dispensing opening 40. Use of a plunger and spring mechanism allows the container 10 to be used in situations where paper products are to be dispensed in a substantially vertical direction.

The plunger 100 is shaped to provide support and lift the paper products 12 through the housing 14 without becoming stuck such that the paper products would no longer be elevated toward the dispensing opening 40. The plunger can have any one of various shapes. In one embodiment, the plunger 100 can take the shape of a truncated cone having a top surface 108 and a bottom surface 110. The top surface 108 engages and lifts an internal platform 82 against the paper products 12. The bottom surface 110 is engaged by the spring 102. The diameter of the bottom surface 110 is desirably substantially equivalent to the diameter of the spring 102. Desirably, the bottom surface 110 of the plunger is attached to the spring 102 to prevent disengagement of the spring from the bottom surface of the plunger.

Desirably, one or more stabilizing wings 112 extend from the plunger 100. The wings 112 act to distribute the force from the spring 102 to the outer edges of the internal platform 82. As shown in FIG. 2, the force is applied by the upper edge 114 of the wing 112 that contacts the internal platform 82. The wings 112 also act to prevent the plunger 100 and spring 102 from tipping over inside the cartridge. If the plunger 100 and spring 102 begin to tip over, the outer edge 116 of the wing 112 contacts the inside surface of the cartridge 70 before the plunger can get stuck. Thus, the surface area of the outer edge 116 is desirably minimized to prevent the outer edge from binding against the inside surface of the cartridge 70. The bevel 118 between the upper edge 114 and the outer edge 116 is configured to transition between the upper edge 114 and the outer edge 116. The wings 112 may have various thicknesses and the thickness of the wing may vary along any dimension or dimensions. Desirably, the outer edge 116 of the wing 112 will be relatively thin and smooth to minimize friction against the inside surface of the cartridge 70.

Referring again to FIG. 5, the spring 102 is sized to provide sufficient force to urge and/or elevate the paper products 12 to the dispensing opening 40. Desirably, the spring applies substantially constant pressure against the paper products at all positions of travel. Application of substantially constant pressure helps to prevent over application of force when the plunger is toward the bottom of the dispenser and under application of force when the plunger is toward the top of the dispenser.

As discussed above, in one embodiment of the invention the bottom of the cartridge is opened prior to insertion of the cartridge into the housing to enable the contents of the cartridge to be engaged by the means for elevating the paper products. To prevent the paper products from falling out of the opening during the insertion process, the cartridge may contain an internal platform. The internal platform is prevented from falling out of the cartridge by platform supports attached to the internal surface of the cartridge. The platform rests unattached above the platform supports so that it will move with the means for urging and/or elevating the paper products as discussed above. The largest dimensions of the platform are slightly smaller than the internal dimensions of the cartridge so that the platform can move through the cartridge as paper products are dispensed without binding against the internal surface of the cartridge. Desirably, the largest dimensions of the platform are substantially equal to or slightly larger than the paper products to provide uniform dispensing of the paper products.

Figure 6:
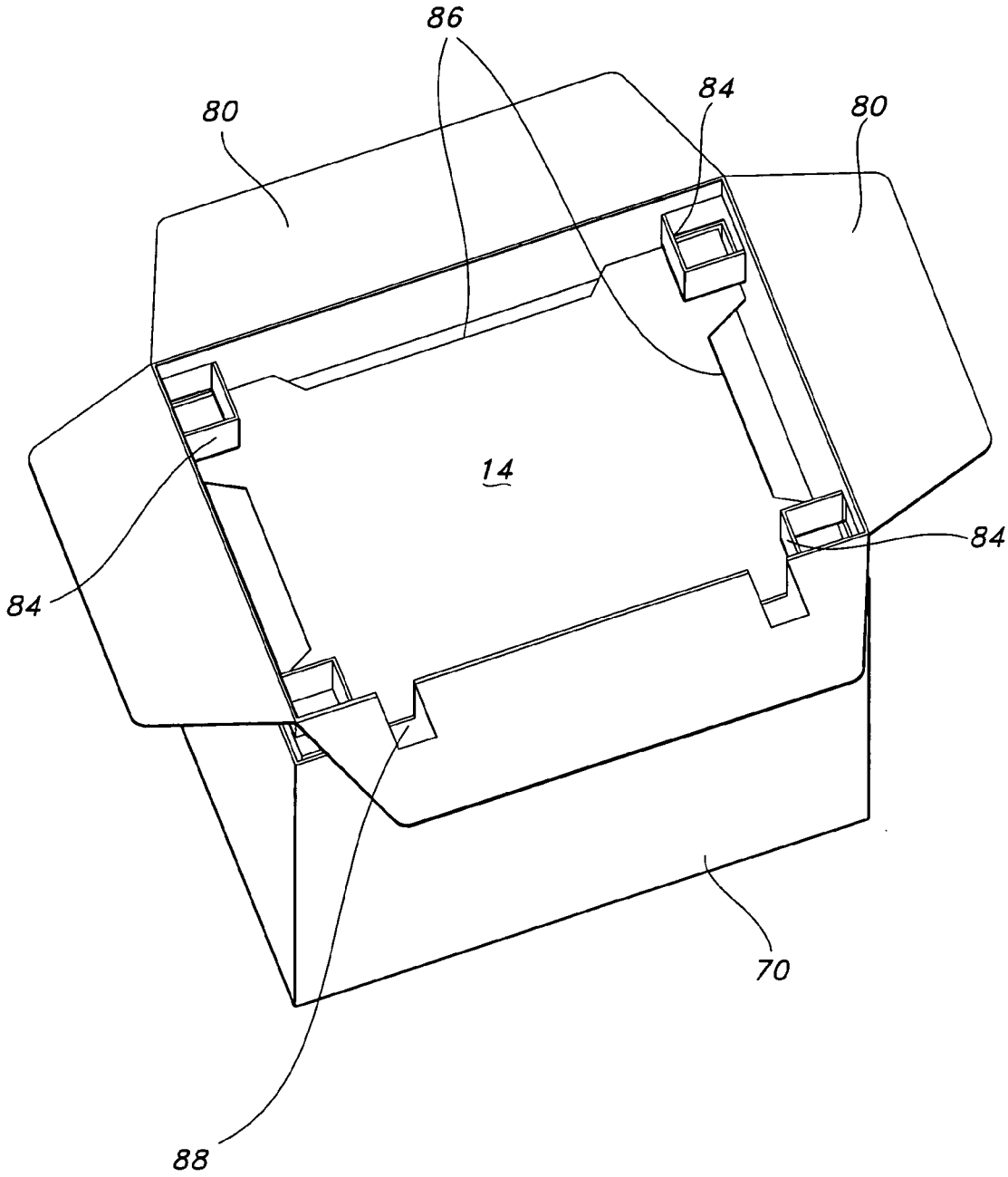
FIG. 6 is a perspective view of the open bottom portion of a cartridge for use with the container of FIG. 1.

FIG. 6 depicts a perspective view of the bottom end 74 of the cartridge 70. The flaps 80 are shown open, exposing the interior area of the cartridge 70. Platform supports 84 are depicted in FIG. 6 above the platform 82. Optionally, notches 86 are present in the sides of the platform to reduce contact of the platform 82 against the inside of the cartridge walls.

The platform supports may take any form, so long as the platform supports are large enough and sufficiently well attached to the interior surface of the cartridge to adequately support the weight of the paper products as the cartridge is being inserted into the housing. As one example, the platform supports may be separate components that are attached to the interior surface of the cartridge. As another example, the platform supports may be formed from partially removable portions in the side walls of the cartridge. At any time after the paper products and internal platform are loaded into the cartridge and before inserting the cartridge into the housing, the partially removable portions may be pressed into the interior of the cartridge to create the platform supports. At least a portion of the platform supports remain attached to the cartridge wall, thereby preventing the platform and paper products from falling from the cartridge when the cartridge is inverted to be loaded into the housing of the container.

Figure 7:
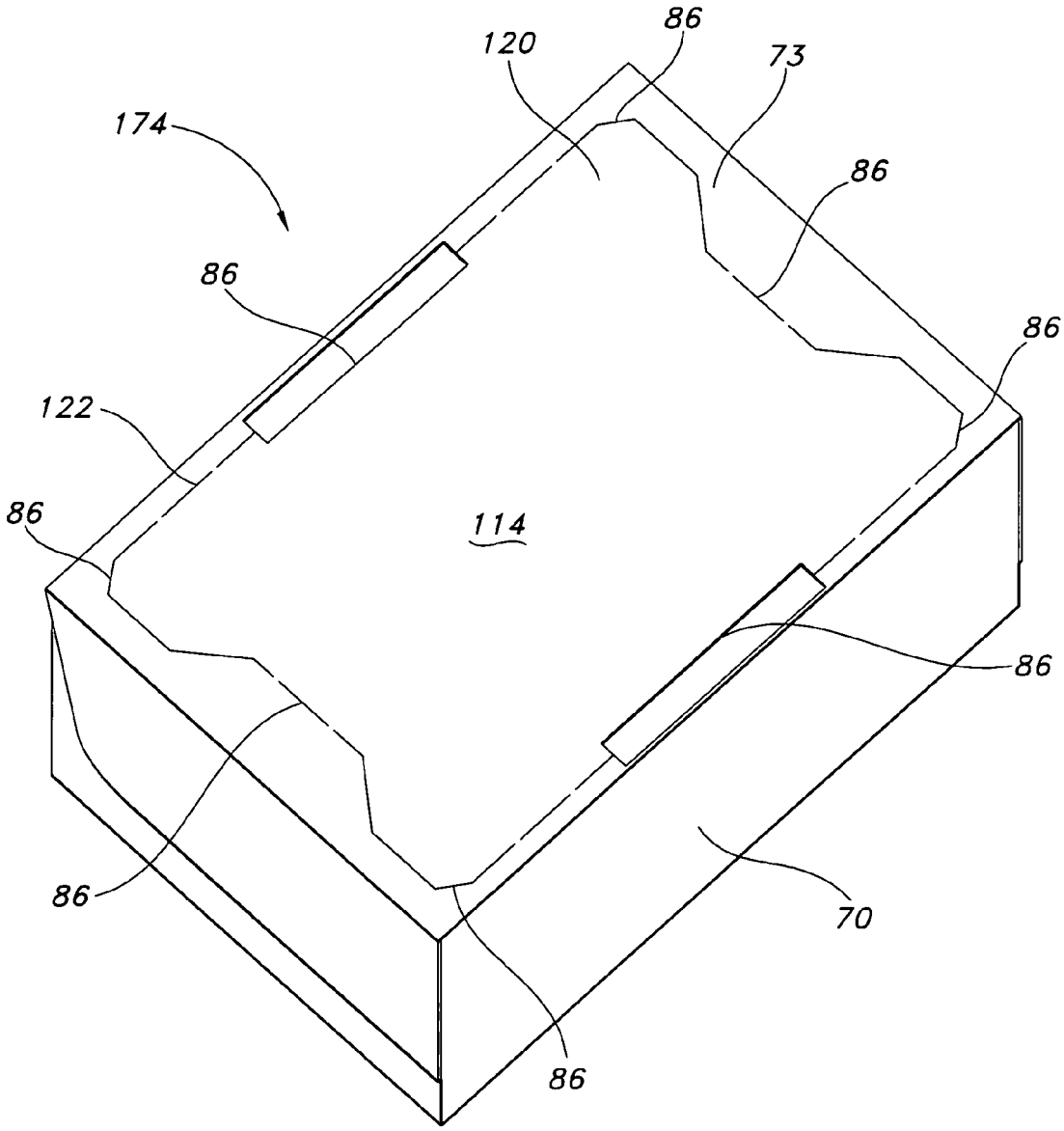
FIG. 7 is a perspective view of the closed bottom portion of another embodiment of a cartridge for use with the container of FIG. 1.

FIGS. 7–12 depict embodiments of the cartridge in which it is not necessary to open the bottom of the cartridge prior to inserting the cartridge in the container. FIG. 7 depicts a perspective view of a bottom end 174 of the cartridge 70 having an end wall 73. Within the end wall 73 is a removable portion 120 defined by a line of weakness 122. Upon separation of the removable portion 120 from the end wall 73, the removable portion becomes an internal platform 114 that supports the paper products within the cartridge 70.

Figure 8:
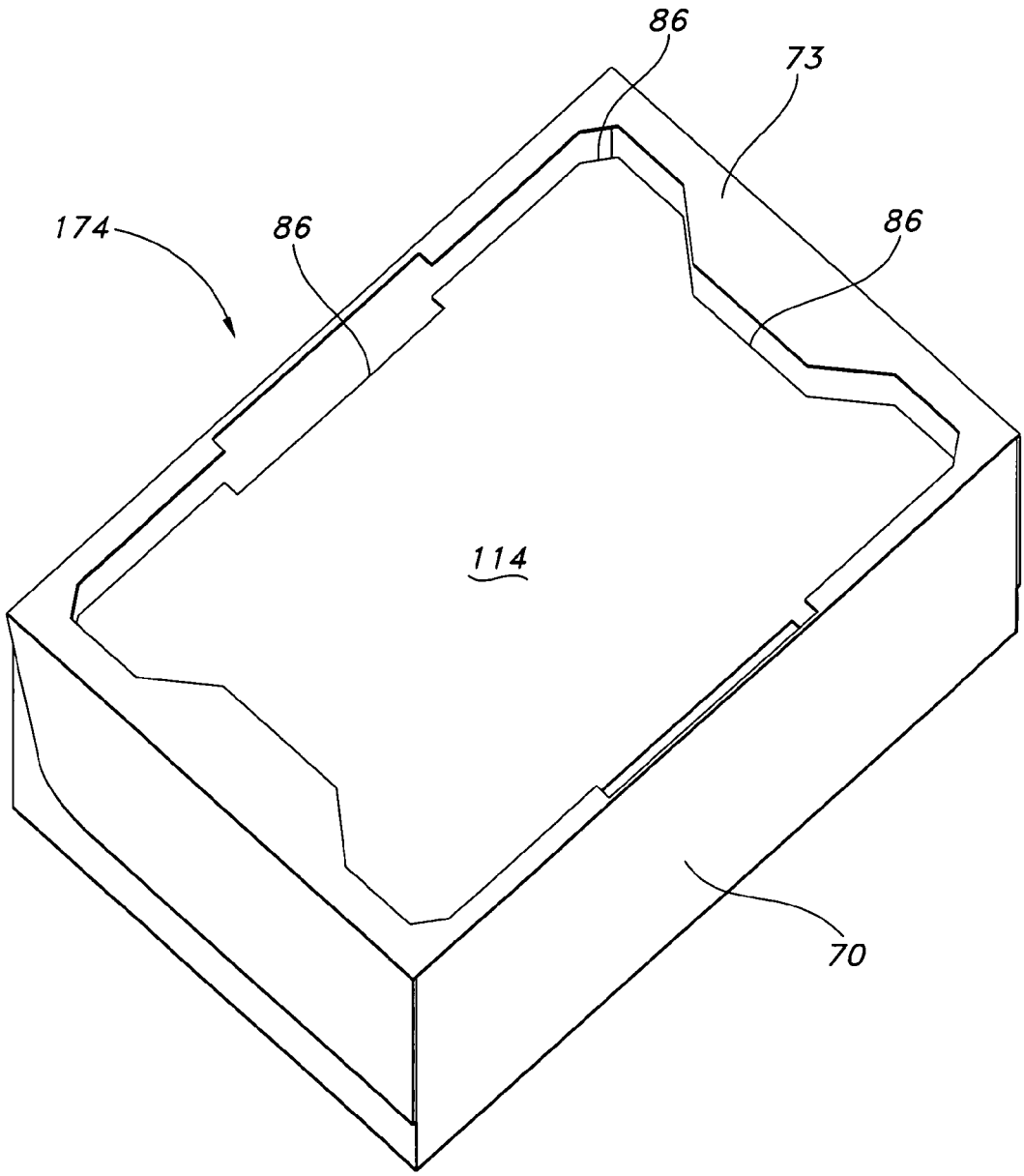
FIG. 8 is a perspective view of the open bottom portion of the cartridge of FIG. 7.

FIG. 8 depicts an operational perspective view of the bottom end 174 of the cartridge 70 depicted in FIG. 7. The removable portion has been separated from the end wall 73. The internal platform 114 is shown inside the cartridge 70 where it supports the paper products therein. Notches 86 in the sides of the internal platform 114 may be used to minimize contact of the internal platform with the inside surfaces of the cartridge 70.

Figure 9:
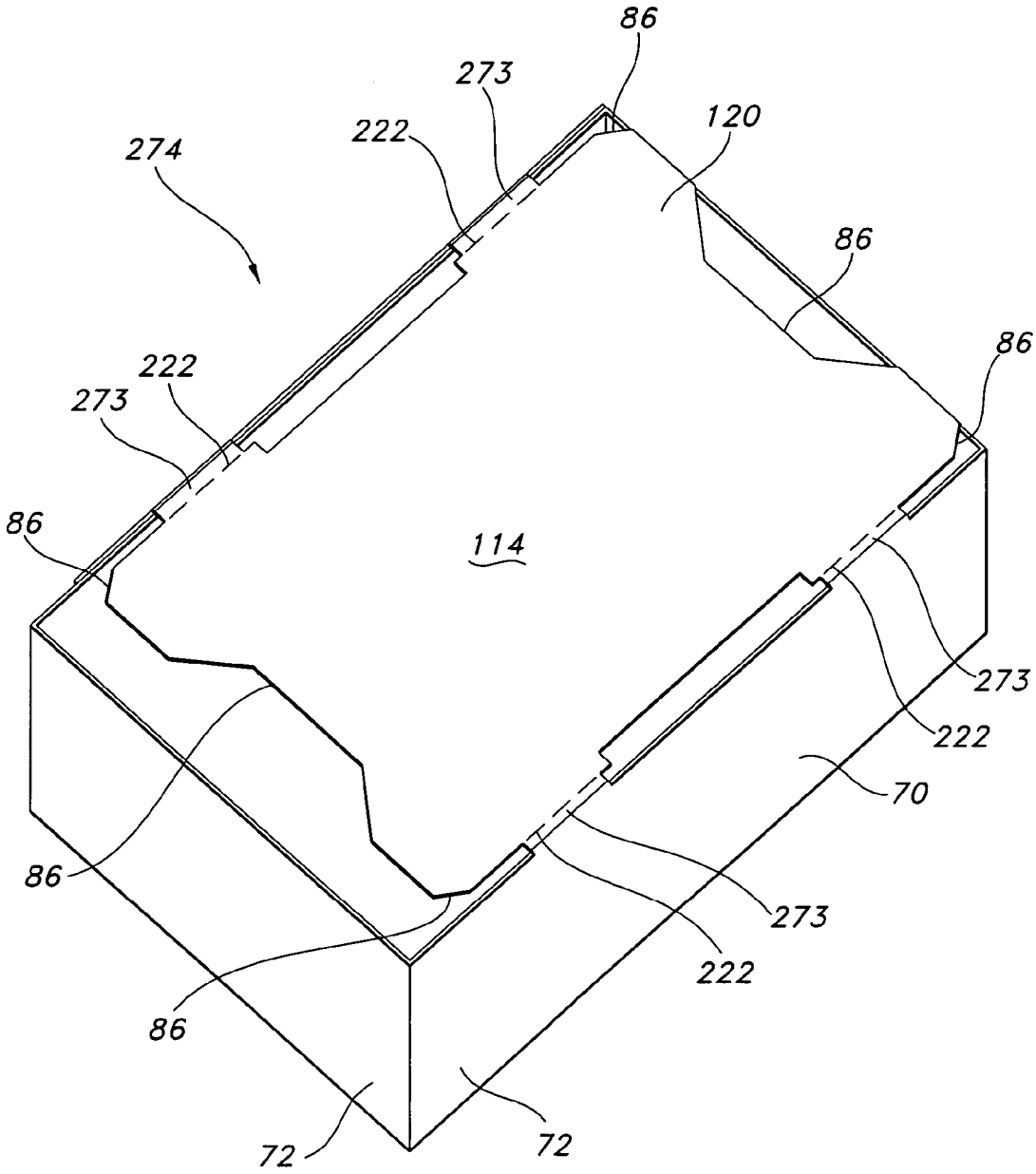
FIG. 9 is a perspective view of the closed bottom portion of another embodiment of a cartridge for use with the container of FIG. 1.

FIG. 9 depicts a perspective view of a bottom end 274 of the cartridge 70. Tabs 273 are attached to and extend from the ends of the outside walls 72. Removably attached to the tabs 273 is a removable portion 120. Lines of weakness 222 enable the removable portion 120 to be separated from the individual tabs 273. Upon separation of the removable portion 120 from the tabs 273, the removable portion becomes an internal platform 114 that supports the paper products within the cartridge 70.

Figure 10:
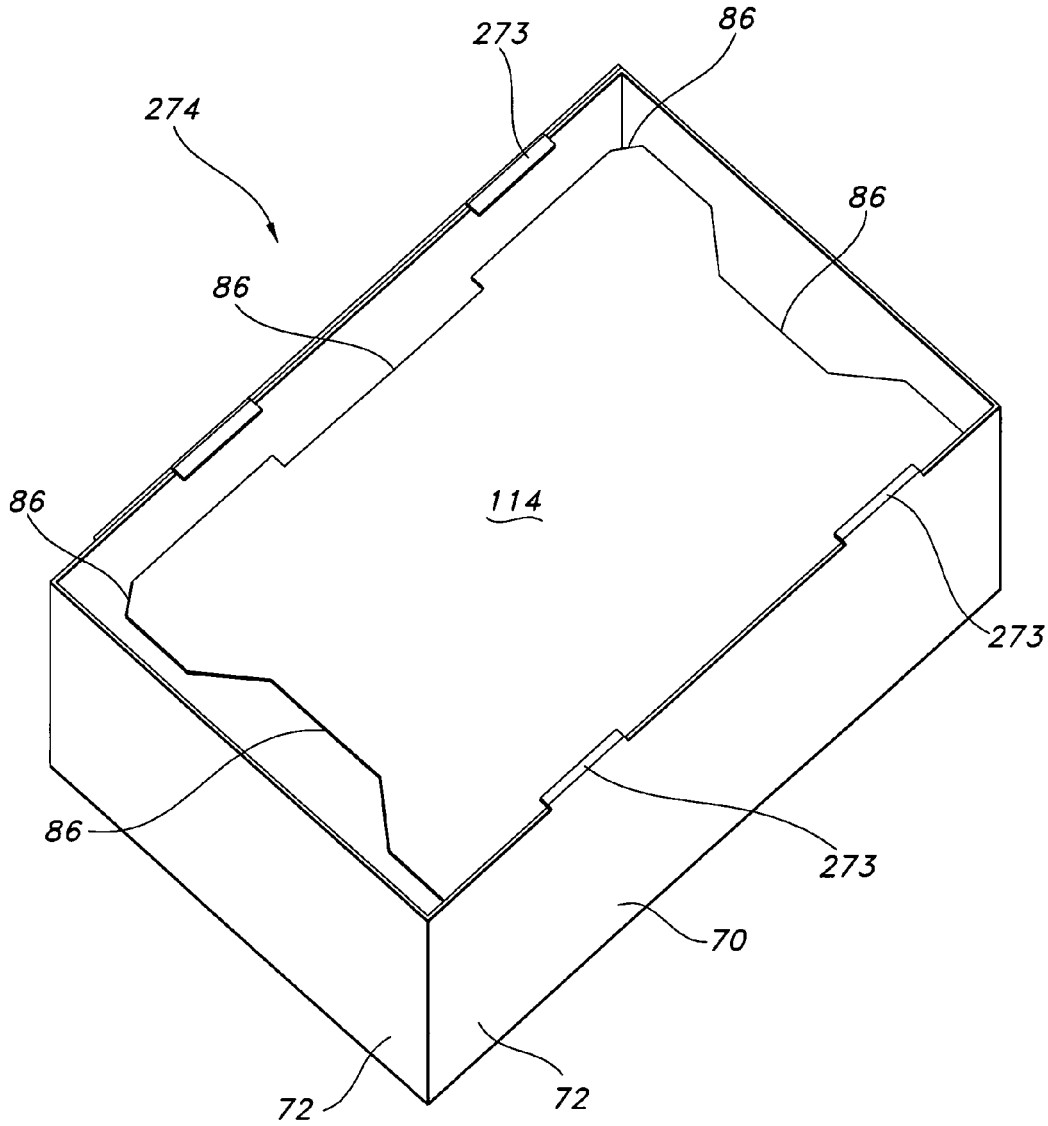
FIG. 10 is a perspective view of the open bottom portion of the cartridge of FIG. 9.

FIG. 10 depicts an operational perspective view of the bottom end 274 of the cartridge 70 depicted in FIG. 9. The removable portion has been separated from the tabs 273. The internal platform 114 is shown inside the cartridge 70 where it supports the paper products therein. As described above, notches 86 in the sides of the internal platform 114 may be used to minimize contact of the internal platform with the inside surfaces of the cartridge 70.

Figure 11:
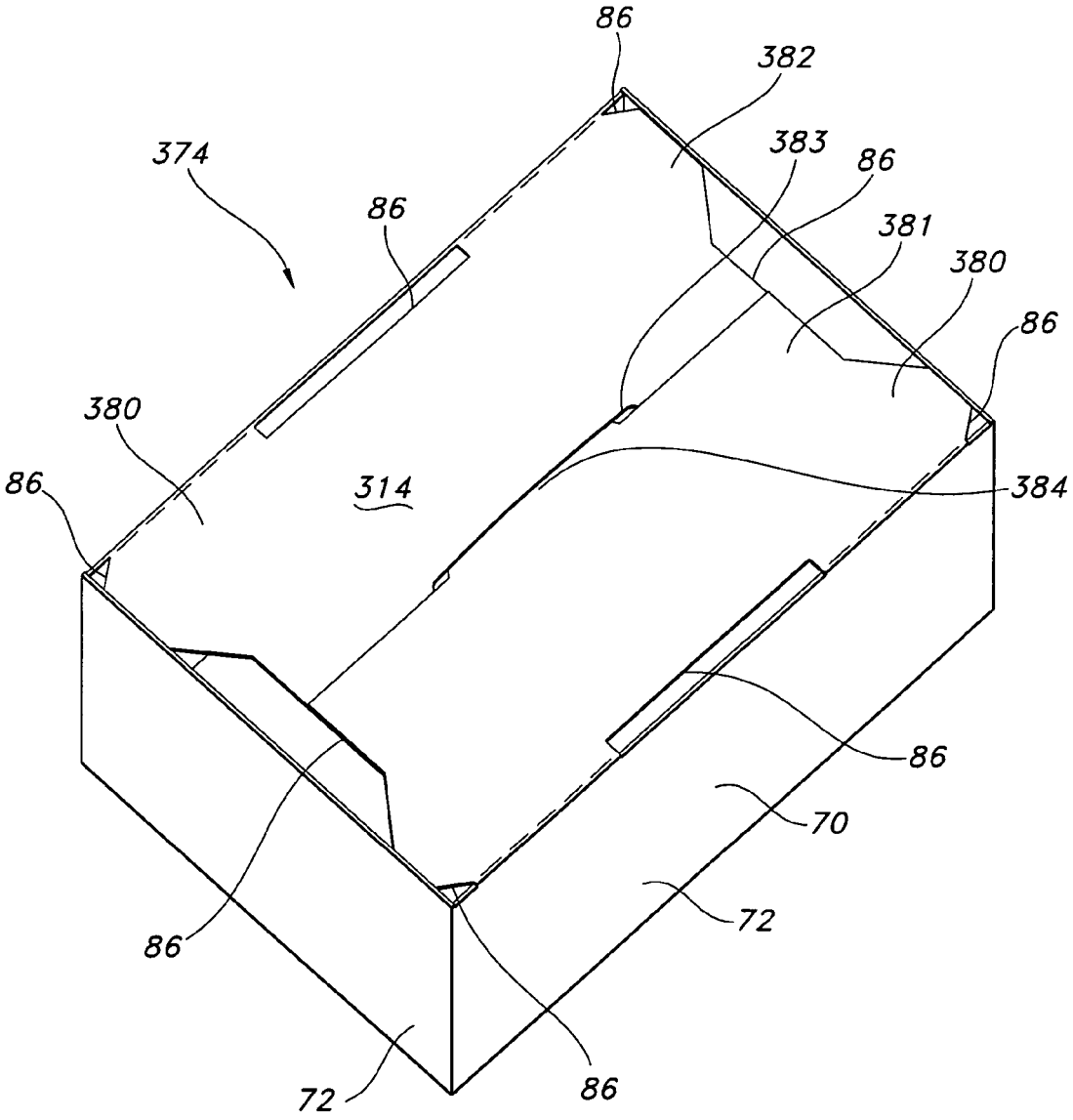
FIG. 11 is a perspective view of the closed bottom portion of another embodiment of a cartridge for use with the container of FIG. 1.

FIG. 11 depicts a perspective view of a bottom end 374 of the cartridge 70. Two or more flaps 380 are attached to and extend from the ends of the outside walls 72. Lines of weakness 322 enable the flaps 380 to be separated from the outside walls 72. Upon separation of the flaps 380 from the outside walls 72, the flaps become an internal platform 314 that supports the paper products within the cartridge 70. Desirably, at least one flap 381 has a slot 383 and at least one opposing flap 382 has a tab 384 removably inserted in the slot. The tab/slot configuration enables the cartridge 70 to be alternatively used in a dispenser which requires opening of the cartridge prior to insertion thereof in a container.

Figure 12:
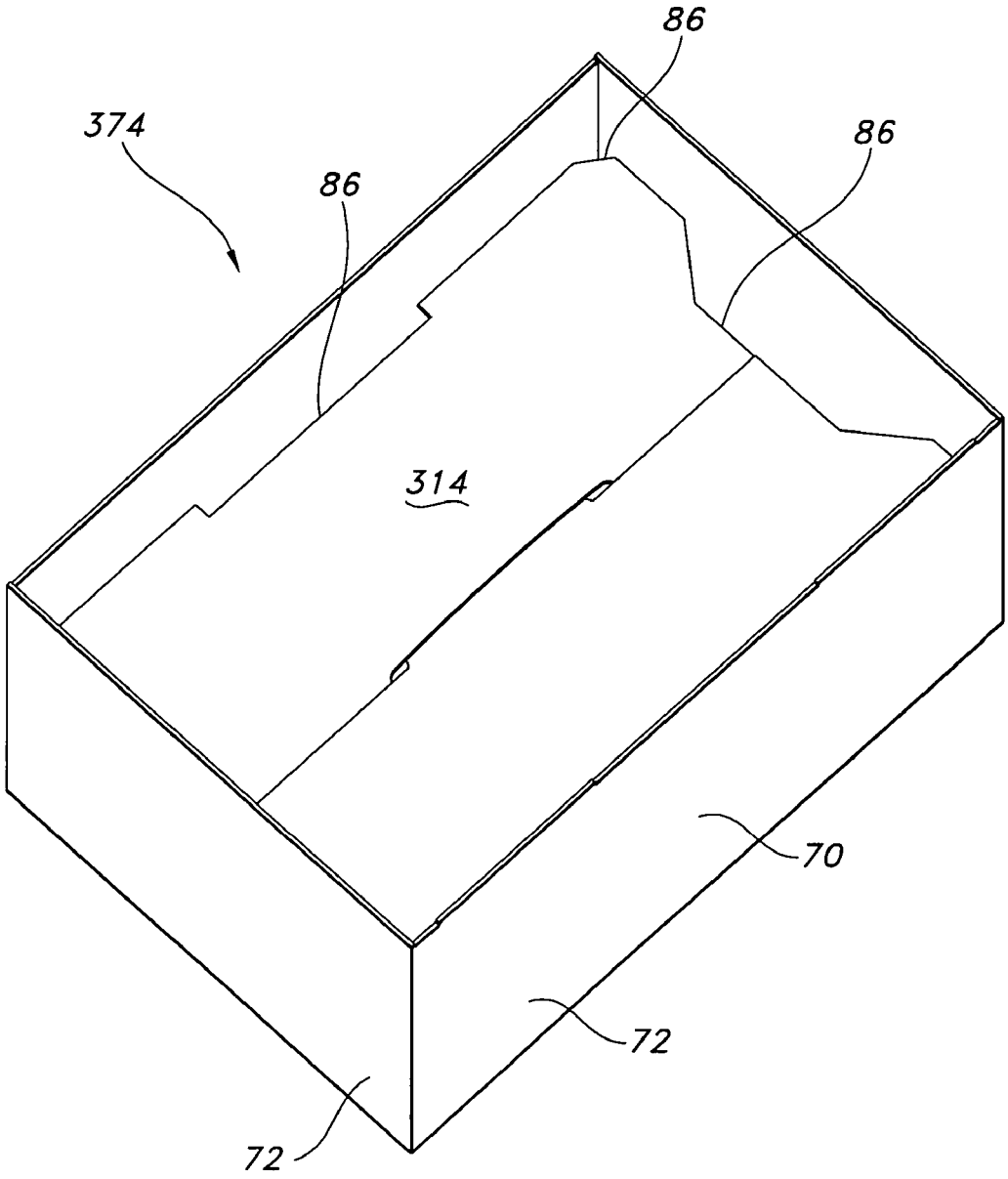
FIG. 12 is a perspective view of the open bottom portion of the cartridge of FIG. 11.

FIG. 12 depicts an operational perspective view of the bottom end 374 of the cartridge 70 depicted in FIG. 11. The flaps have been separated from the outside walls 72. The internal platform 314 is shown inside the cartridge 70 where it supports the paper products therein. As described above, notches 86 in the sides of the internal platform 314 may be used to minimize contact of the internal platform with the inside surfaces of the cartridge 70.

Figure 13:
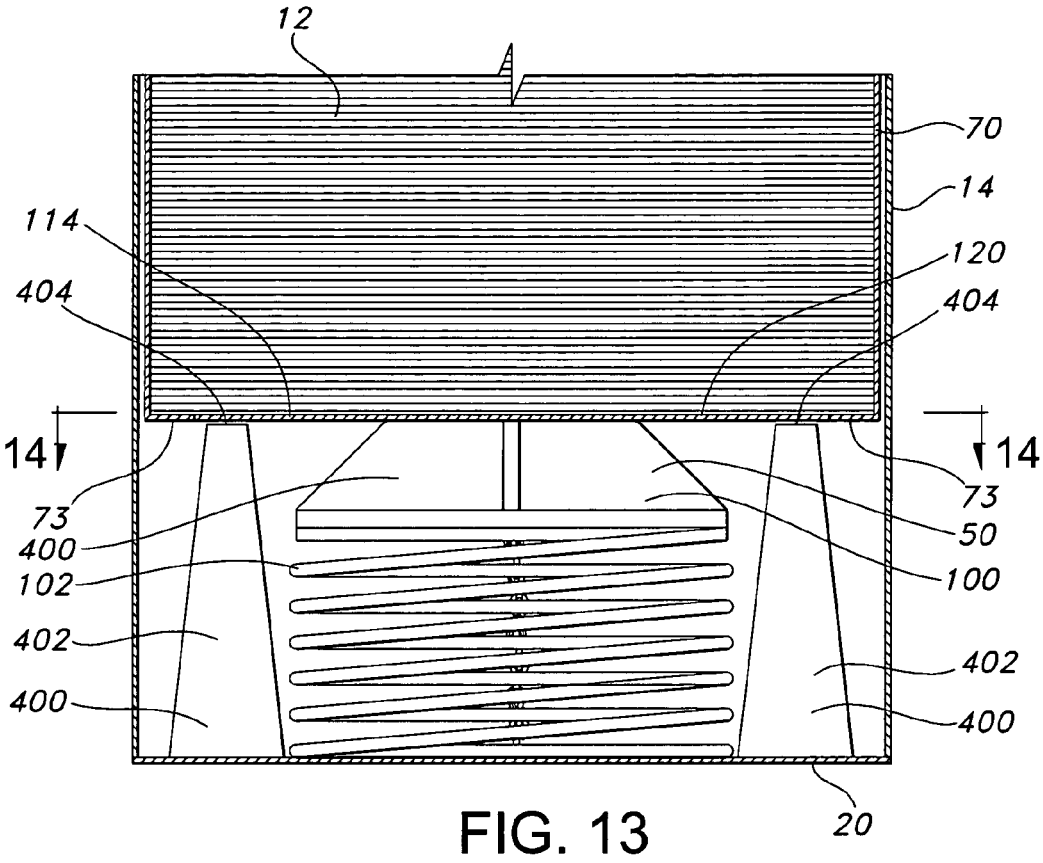
FIG. 13 is a partial cross-sectional view of an alternate embodiment of a container and cartridge for dispensing paper products.
Figure 14:
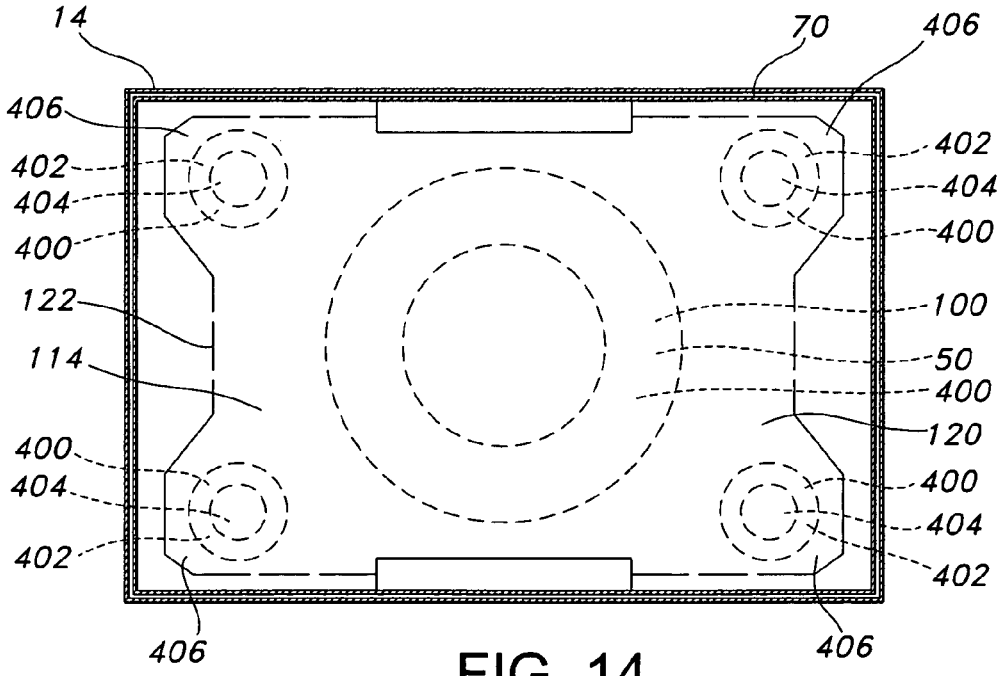
FIG. 14 is a top view of the container and cartridge of FIG. 13 taken along line 14—14 of FIG. 14.

As noted above, the cartridges depicted in FIGS. 7–12 have removable portions that do not require removal prior to insertion of the cartridge into the container. Referring to FIGS. 13 & 14, the cartridge 70 is configured for insertion in a container 10 including an internal member 400 positioned to engage the removable portion 120 of the cartridge and separate the removable portion therefrom. For example, the internal member 400 may be the plunger 100 or the means for urging paper products 50. As another example, the container 10 may include at least one tower 402 anchored to the inside surface of the bottom wall 20 of the housing 14. The at least on tower 402 is positioned on the inside surface of the bottom wall 20 where it will not interfere with the functioning of the means for elevating paper products 50. The at least one tower 402 extends from the bottom wall 20 toward the opening (not shown) in the housing 14 through which the cartridge 70 is loaded. The length or height of the at least one tower 402 is such that it extends past the plunger 100 when the plunger has fully compressed the spring 102 below. Thus, when the cartridge 70 is inserted into the housing 14 of the container 10, compressing the spring 102, the end wall 73 of the cartridge contacts the top of the at least one tower 402 before the spring is fully compressed.

The at least one tower 402 includes a top 404 that contacts the removable portion 120 when the cartridge 70 is inserted in the container 10. Desirably, the top 404 of the at least one tower 402 contacts the removable portion 120 at or near the line of weakness 122 to cause the removable portion to be separated without ripping or tearing of end wall 73. The cross-sectional area of the top 404 of the at least one tower 402 should be selected so that the top will separate the removable portion 120 rather than puncturing the removable portion. For example, the cross-sectional area of the top 404 may be greater than 0.5 $cm^2$, and desirably may be greater than 1 $cm^2$. Desirably, as many towers 402 may be used as are necessary to provide a clean separation of the removable portion 120 from the end wall 73. In a particularly desirably configuration, four towers 402 are positioned at or near the corners 406 of the removable portion 120.

To load a cartridge 70 having an end wall 73 with a removable portion 120 that does not require removal prior to loading, the cartridge is inserted into the container 10 with the end wall 73 facing against the means for elevating paper products 50. As an example, the end wall 73 of the cartridge 70 having the removable portion 120 capable of receiving the means for elevating paper products can be positioned against the plunger 100 attached to the spring 102 within the container 10. The cartridge 70 is then pushed down against the plunger 100, depressing the plunger against the spring 102 until the cartridge is nearly seated in the housing 14 of the container 10. Just prior to the cartridge 70 being fully seated, the removable portion 120 is separated from the end wall 73 of the cartridge 70 by either the fully compressed plunger 100 or, if present, the at least one tower 402. In this regard, the force on the removable portion 120 exerted by either the spring-loaded plunger 100 or the at least one tower 402 exceeds the perforation strength of the lines of weakness 122 defining and restraining the removable portion in the end wall 73 of the cartridge 70, and the removable portion becomes separated therefrom. Once the removable portion 120 becomes separated from the end wall 73 of the cartridge 70, the removable portion serves as an internal platform 114 to provide support to the paper products 12 as the paper products are urged towards the dispenser opening.

It will be apparent to those skilled in the art that various modifications and variations can be made in the present invention without departing from the scope and spirit of the invention. It is intended that the present invention include such modifications and variations as come within the scope of the appended claims and their equivalents.

What is claimed is:

1. A system for dispensing individual paper products, the system comprising:

a container, the container comprising:

a housing including side walls and a bottom wall defining an interior surface and an interior area within the interior surface;

a cover hingedly or removably attached to the housing wherein the cover defines a dispensing opening;

a spring disposed in the interior area of the housing; and a plunger disposed in the interior area of the housing wherein the spring is compressed between the plunger and at least one of the walls, and further wherein the plunger is urged toward the dispensing opening by the spring; and a cartridge containing paper products, the cartridge positioned at least partially within the interior area of the container, the cartridge defining a removable portion, the removable portion being adapted to become separated from the cartridge by contact with the plunger when the cartridge is inserted in the container, removal of the removable portion creating a second opening, wherein after the removable portion is separated from the cartridge the plunger extends through the second opening into the cartridge to urge the removable portion to contact the paper products and urge the paper products toward the dispensing opening.

2. The system of claim 1 wherein the plunger comprises a truncated cone.

3. The system of claim 2 wherein the truncated cone comprises a bottom surface having a diameter substantially equivalent to the diameter of the spring.

4. The system of claim 2 further wherein the plunger comprises at least one stabilizing wing.

5. The system of claim 4 wherein the at least one stabilizing wing has an outer edge that contacts the inside surface of the housing to prevent the plunger from binding in the housing.

6. The system of claim 1 wherein the removable portion comprises an internal platform in contact with the plunger.

7. The system of claim 6 wherein the internal platform comprises notches to minimize contact of the internal platform with the internal surface of the housing.

8. The system of claim 6 wherein the paper products are urged toward the dispensing opening by the internal platform.

9. The system of claim 8 wherein the internal platform applies substantially constant pressure against the paper products.

10. The system of claim 1 wherein the cartridge comprises cartridge side walls, a first end wall defining a third opening for dispensing the paper products, and a second end wall opposing the first end wall, wherein the removable portion is defined by the second end wall.

11. The system of claim 1 wherein the removable portion comprises at least one flap.

12. The system of claim 1 wherein the removable portion comprises a first flap having a tab and a second flap having a slot, the tab being removably inserted in the slot.

13. The system of claim 1 wherein the removable portion is defined by perforations.

14. The system of claim 1 wherein the container is positioned within a supporting structure.

15. The system of claim 1 wherein the paper products are urged toward the dispensing opening in a substantially vertical direction.

16. A system for dispensing individual paper products, the system comprising:

a container, the container comprising:

a housing including side walls and a bottom wall defining an interior surface and an interior area within the interior surface for receiving a plurality of the paper products;

a cover hingedly or removably attached to the housing wherein the cover defines a dispensing opening; and a means for elevating paper products; and a cartridge containing paper products, the cartridge positioned at least partially within the interior area of the container, the cartridge defining a removable portion, the removable portion being adapted to become separated from the cartridge by contact with the means for elevating paper products when the cartridge is inserted in the container, removal of the removable portion creating a second opening, wherein after the removable portion is separated from the cartridge the means for elevating paper products extends through the second opening into the cartridge to urge the removable portion to contact the paper products and urge the paper products toward the dispensing opening.

17. A system for dispensing individual paper products, the system comprising:

a container, the container comprising:

a housing including walls defining an interior surface and an interior area within the interior surface;

a cover wherein the cover defines a dispensing opening;

a spring disposed in the interior area of the housing; and a plunger disposed in the interior area of the housing wherein the spring is compressed between the plunger and at least one of the walls, and further wherein the plunger is urged toward the dispensing opening by the spring; and a cartridge containing paper products, the cartridge positioned at least partially within the interior area of the container, the cartridge defining a removable portion, the removable portion capable of becoming separated from the cartridge by contact with the plunger when the cartridge is inserted in the container, separation of the removable portion from the cartridge creating a second opening, wherein after separation of the removable portion from the cartridge the plunger extends through the second opening into the cartridge to urge the removable portion to contact the paper products and urge the paper products toward the dispensing opening.

18. A method for loading paper products in a system for dispensing paper products, the method comprising the steps of:

a) providing a container, the container comprising a housing including side walls and a bottom wall defining an interior surface and an interior area within the interior surface; a cover hingedly or removably attached to the housing wherein the cover defines a dispensing opening; a spring disposed in the interior area of the housing; and a plunger disposed in the interior area of the housing wherein the spring is compressed between the plunger and at least one of the walls, and further wherein the plunger is urged toward the dispensing opening by the spring;

b) providing a cartridge containing paper products, the cartridge defining a removable portion, the removable portion being adapted to become separated from the cartridge by contact with the plunger when the cartridge is inserted in the container; and c) inserting the cartridge in the container to cause the plunger to separate the removable portion from the cartridge to create a second opening, wherein after the removable portion is separated from the cartridge the plunger extends through the second opening into the cartridge to urge the removable portion to contact the paper products and urge the paper products toward the dispensing opening.

19. The method of claim 18 wherein the removable portion comprises a first flap having a tab and a second flap having a slot, the tab being removably inserted in the slot.

20. The method of claim 18 wherein the removable portion is defined by perforations.

21. A system for dispensing individual paper products, the system comprising:

a container, the container comprising:

a housing including side walls and a bottom wall defining an interior surface and an interior area within the interior surface;

a cover hingedly or removably attached to the housing wherein the cover defines a dispensing opening;

a spring disposed in the interior area of the housing;

a plunger disposed in the interior area of the housing wherein the spring is compressed between the plunger and at least one of the walls, and further wherein the plunger is urged toward the dispensing opening by the spring; and at least one internal member anchored to the bottom wall; and a cartridge containing paper products, the cartridge positioned at least partially within the interior area of the container, the cartridge defining a removable portion, the removable portion being adapted to become separated from the cartridge by contact with the at least one internal member when the cartridge is inserted in the container, removal of the removable portion creating a second opening, wherein after the removable portion is separated from the cartridge the plunger extends through the second opening into the cartridge to urge the removable portion to contact the paper products and urge the paper products toward the dispensing opening.

22. The system of claim 21 wherein the at least one internal member comprises at least one tower.

23. The system of claim 22 wherein the at least one internal tower comprises four towers.

24. The system of claim 23 wherein the towers comprise tops having cross-sectional areas of greater than about 0.5 $cm^2$.

25. The system of claim 21 wherein the removable portion comprises an internal platform in contact with the plunger.

26. The system of claim 25 wherein the internal platform comprises notches to minimize contact of the internal platform with the internal surface of the housing.

27. The system of claim 21 wherein the cartridge comprises cartridge side walls, a first end wall defining a third opening for dispensing the paper products, and a second end wall opposing the first end wall, wherein the removable portion is defined by the second end wall.

28. The system of claim 21 wherein the removable portion comprises at least one flap.

29. The system of claim 21 wherein the removable portion comprises a first flap having a tab and a second flap having a slot, the tab being removably inserted in the slot.

30. The system of claim 21 wherein the removable portion is defined by perforations.

31. A system for dispensing individual paper products, the system comprising:

a container, the container comprising:

a housing including side walls and a bottom wall defining an interior surface and an interior area within the interior surface for receiving a plurality of the paper products;

a cover hingedly or removably attached to the housing wherein the cover defines a dispensing opening;

a means for elevating paper products; and at least one internal member anchored to the bottom wall; and a cartridge containing paper products, the cartridge positioned at least partially within the interior area of the container, the cartridge defining a removable portion, the removable portion being adapted to become separated from the cartridge by contact with the at least one internal member when the cartridge is inserted in the container, removal of the removable portion creating a second opening, wherein after the removable portion is separated from the cartridge the means for elevating paper products extends through the second opening into the cartridge to urge the removable portion to contact the paper products and urge the paper products toward the dispensing opening.

32. A system for dispensing individual paper products, the system comprising:

a container, the container comprising:

a housing including walls defining an interior surface and an interior area within the interior surface;

a cover wherein the cover defines a dispensing opening;

a spring disposed in the interior area of the housing;

a plunger disposed in the interior area of the housing wherein the spring is compressed between the plunger and at least one of the walls, and further wherein the plunger is urged toward the dispensing opening by the spring; and at least one internal member anchored to a bottom wall; and a cartridge containing paper products, the cartridge positioned at least partially within the interior area of the container, the cartridge defining a removable portion, the removable portion capable of becoming separated from the cartridge by contact with the at least one internal member when the cartridge is inserted in the container, separation of the removable portion from the cartridge creating a second opening, wherein after separation of the removable portion from the cartridge the plunger extends through the second opening into the cartridge to urge the removable portion to contact the paper products and urge the paper products toward the dispensing opening.

33. A method for loading paper products in a system for dispensing paper products, the method comprising the steps of:

a) providing a container, the container comprising a housing including side walls and a bottom wall defining an interior surface and an interior area within the interior surface; a cover hingedly or removably attached to the housing wherein the cover defines a dispensing opening; a spring disposed in the interior area of the housing; a plunger disposed in the interior area of the housing wherein the spring is compressed between the plunger and at least one of the walls, and further wherein the plunger is urged toward the dispensing opening by the spring; and at least one internal member anchored to the bottom wall;

b) providing a cartridge containing paper products, the cartridge defining a removable portion, the removable portion being adapted to become separated from the cartridge by contact with the at least one internal member when the cartridge is inserted in the container; and c) inserting the cartridge in the container to cause the at least one internal member to separate the removable portion from the cartridge to create a second opening, wherein after the removable portion is separated from the cartridge the plunger extends through the second opening into the cartridge to urge the removable portion to contact the paper products and urge the paper products toward the dispensing opening.

34. The system of claim 33 wherein the at least one internal member comprises at least one tower.

35. The system of claim 34 wherein the at least one internal member comprises four towers.

36. The system of claim 35 wherein the towers comprise tops having cross-sectional areas of greater than about 0.5 $cm^2$.

37. The method of claim 33 wherein the removable portion comprises a first flap having a tab and a second flap having a slot, the tab being removably inserted in the slot.

38. The method of claim 33 wherein the removable portion is defined by perforations.

* * * * *